United States Patent [19]

Hirokoh et al.

[11] Patent Number: 4,818,374

[45] Date of Patent: Apr. 4, 1989

[54] PROCESS FOR CONVERTING COAL TO AN OIL FRACTION

[75] Inventors: Nobuyoshi Hirokoh, Tokyo; Yoichi Kageyama, Isehara; Yukio Nakako, Takarazuka; Tetsuo Matsumura, Kobe, all of Japan

[73] Assignees: Mitsubishi Chemical Industries Ltd., Tokyo; Kabushiki Kaisha Kobe Seiko Sho, Kobe; Idemitsu Kosan Company Limited, Tokyo; Asia Oil Company Limited, Tokyo; Nippon Brown Coal Liquefaction Co., Ltd., Tokyo, all of Japan

[21] Appl. No.: 795,729

[22] Filed: Nov. 8, 1985

Related U.S. Application Data

[63] Continuation of Ser. No. 610,651, May 16, 1984, abandoned.

[30] Foreign Application Priority Data

May 16, 1983 [JP] Japan ..... 58-85566

[51] Int. Cl.[4] ..... C10G 1/06

[52] U.S. Cl. ..... 208/413; 208/417; 208/422; 208/435

[58] Field of Search ..... 208/10, 422, 435, 413, 208/417

[56] References Cited

U.S. PATENT DOCUMENTS

| | | | |
|---|---|---|---|
| 2,572,061 | 10/1951 | Sellers | 208/10 |
| 3,162,594 | 12/1964 | Gorin | 208/10 |
| 3,700,584 | 10/1972 | Johanson et al. | 208/10 |
| 3,997,425 | 12/1976 | Gatsis et al. | 208/8 LE |
| 4,134,821 | 1/1979 | Gorin | 208/10 |
| 4,290,880 | 9/1981 | Leonard | 208/309 |
| 4,303,498 | 12/1981 | Chikata et al. | 208/8 LE |
| 4,314,898 | 2/1982 | Nakako et al. | 208/8 LE |
| 4,322,284 | 3/1982 | Tsai et al. | 208/10 |
| 4,330,388 | 5/1982 | Anderson et al. | 208/8 LE |
| 4,347,117 | 8/1982 | Bauman et al. | 208/8 LE |
| 4,371,727 | 2/1983 | Gavin | 208/10 |
| 4,372,838 | 2/1983 | Kulik et al. | 208/8 LE |
| 4,374,015 | 2/1983 | Brulé | 208/10 |
| 4,411,767 | 10/1983 | Garg | 208/413 |
| 4,491,511 | 1/1985 | Skinner et al. | 208/8 LE |
| 4,522,700 | 6/1985 | Schindler | 208/8 LE |
| 4,534,847 | 8/1985 | Roberts et al. | 208/413 |
| 4,536,275 | 8/1985 | Bronfenbrenner et al. | 208/10 |
| 4,537,675 | 8/1985 | Silver et al. | 208/10 |
| 4,541,914 | 9/1985 | Hirokoh et al. | 208/413 |
| 4,544,476 | 10/1985 | Long et al. | 208/10 |
| 4,547,282 | 10/1985 | Schindler | 208/10 |
| 4,565,622 | 1/1986 | Nakako et al. | 208/413 |
| 4,737,266 | 4/1988 | Kageyama et al. | 208/423 |

*Primary Examiner*—John Doll
*Assistant Examiner*—Jeffrey Edwin Russel
*Attorney, Agent, or Firm*—Oblon, Fisher, Spivak, McClelland & Maier

[57] ABSTRACT

A process for converting coal to an oil fraction, which comprises subjecting coal to a first hydrogenation reaction, deashing the reaction product of the first hydrogenation reaction and subjecting the deashed liquefied oil to a second hydrogenation reaction, wherein coal, a solvent and hydrogenation-treated heavy oil components are supplied for the first hydrogenation reaction; from the first hydrogenation reaction product, at least a part of the oil fraction is obtained; from the first hydrogenation reaction product, a substantial amount of preasphaltene components is removed simultaneously with or independently of the deashing operation, and the deashed liquefied oil containing heavy oil components and not greater than 20% by weight of preasphaltene components thereby obtained, is supplied for the second hydrogenation reaction; from the second hydrogenation reaction product, an oil fraction and heavy oil components are separated and the heavy oil components are recycled to the first hydrogenation reaction in an amount of at least 20% by weight relative to the heavy oil components in said deashed liquefied oil.

12 Claims, No Drawings

PROCESS FOR CONVERTING COAL TO AN OIL FRACTION

This application is a continuation of application Ser. No. 610,651, filed May 16, 1984, abandoned.

THE BACKGROUND OF THE INVENTION

1. Field of the Invention

The present invention relates to a process for producing oil fractions by liquefying coals, particularly non-caking coals such as brown coal and sub-bituminous coal. More particularly, it relates to an improved process for producing oil fractions from such coals by a two-step hydrogenation method.

In general, when coal is heated together with a hydrocarbon solvent under hydrogen pressure, condensed polynuclear aromatic compounds which comprise the coal undergo hydrogenation, which results in the solid coal becoming soluble in a solvent. Then, after the removal of non-dissolved coal which remains in a solvent-insoluble form because it does not undergo hydrogenation and the ash content of the coal by a separation operation such as filtration, if the solvent is distilled off, a heavy liquefied product (hereinafter referred to simply as "CLB" i.e. Coal Liquid Bottom) can be obtained. From CLB, it is possible to produce oil fractions such as naphtha or gasoline by subjecting CLB to a further treatment such as hydrogenation. Various methods are being studied to accomplish this objective. The coal reserves in the world are estimated to be about $10^{13}$ tons, and about 25% of these reserves are said to be low quality coals of low coalification rank such as brown coal which has a low utilization value. In the recent past it has become extremely important to be able to modify or convert such brown coal or sub-bituminous coal efficiently into oil fractions which have a wide range of applications, not to mention the problem of petroleum shortage.

Research for the production of oil fractions from coals was extensively conducted in Germany prior to the second World War, then declined as the petroleum era started, and recently regained its importance. Various studies are being made in the United States, West Germany and various other countries in the world, and various techniques for the liquefaction of coals have been proposed. The techniques so far studied may be generally classified into single step processes and two step processes. The single step processes include SRC II process of Gulf Company, U.S.A., EDS process of Exxon, H-Coal process of Hydrocarbon Research Institute, and New IG process of Rule Coley Co., West Germany. In these single step processes, hydrogenation is conducted in a single step in the presence or absence of a fluidized catalyst at a high temperature and under a high pressure. However, they have various drawbacks such as that the selectivity of conversion to the desired oil fractions is rather low and the apparatus which are used are expensive since the reaction is conducted under severe conditions at a high temperature in a high pressure atmosphere.

On the other hand, International Coal Refining Co. and Lummus Co., in U.S.A., have proposed their own two step processes for liquefaction, and Chevron Co. has proposed a three step process for liquefaction, and these processes are being developed. In these processes, the first hydrogenation is conducted in a relatively short period of time under relatively high temperature and high pressure conditions in the presence or absence of a fluidized catalyst until the coal is liquefied or until a solvent refined coal is obtained, and then after separating the ash content, the catalysts and the solvent from the hydrogenation reaction product, the second hydrogenation reaction is conducted in the presence of a catalyst.

As compared with the single step process, these multi-step processes have advantages such as that the reaction conditions are mild, at least part of the ash content, heavy metals and the like is removed, whereby the effective life of the catalysts for the second hydrogenation can be prolonged, and the selectivity for the desired product can be improved. However, in the conventional two step processes for liquefaction, the yield of the oil fraction from the coal has not yet reached a satisfactory level. If an attempt is made to increase the yield, the reaction conditions which are required to do this are severe particularly in the second hydrogenation reaction, which leads to deactivation of the secondary hydrogenation catalysts, as well as an increase of the costs.

The present inventors have conducted extensive research to overcome these difficulties which are inherent in the conventional processes and to provide a process for liquefying coal, which is economically feasible. As a result, it has been found that the preasphaltene components are the major factor for the deactivation of the catalyst in the second hydrogenation step, and that it is possible to moderate not only the second hydrogenation reaction conditions, but also the first hydrogenation reaction conditions and maximize the overall yield of the oil fraction from the coal. The results of the invention are achieved by controlling the amounts of the preasphaltene components and by controlling the conversion of the heavy oil components in the deashed liquefied oil which is supplied to the second hydrogenation reaction so that a substantial amount of heavy oil components is present in the secondary hydrogenation reaction product. A further aspect of the invention is the recycling of the heavy oil components to the first hydrogenation reaction zone. Thus, it has been found possible to realize an industrially advantageous process for converting coal to the oil fraction. The present invention is based on these discoveries.

Namely, it is an object of the present invention to provide a method of converting coal to an oil fraction, which is industrially extremely valuable, by substantially improving the yield of the oil fraction from the coal. Such an object can readily be attained by a process for converting coal to an oil fraction, which comprises subjecting coal to a first hydrogenation reaction, deashing the reaction product of the first hydrogenation reaction and subjecting the deashed liquefied oil to a second hydrogenation reaction. In the process coal, a solvent and hydrogenated heavy oil components are supplied to the first hydrogenation reactor; at least a part of the oil fraction from the first hydrogenation reaction product is obtained; a substantial amount of preasphaltene components is removed simultaneously with or independently of the deashing operation from the first hydrogenation reaction product, and the deashed liquefied oil containing heavy oil components and not greater than 20% by weight of preasphaltene components thereby obtained, is supplied to the second hydrogenation reactor; an oil fraction and heavy oil components are separated from the second hydrogenation reaction product, and the heavy oil components are recycled to the first hydrogenation reaction in an amount of at least 20% by weight relative to the heavy oil components in said deashed liquefied oil.

DESCRIPTION OF THE PREFERRED EMBODIMENTS

According to the present invention, coal, a solvent and hydrogenated heavy oil components are supplied to the first hydrogenation reactor together with a catalyst. Preferably, the coal is pulverized to a particle size of at most 0.1 mm, and then combined with other components to form a slurry, which is then supplied to the reaction zone.

Suitable coal materials which can be used include brown coal, bituminous coal or sub-bituminous coal. In the process of the present invention, it is particularly preferred to employ brown coal or sub-bituminous coal.

As the solvent, it is possible to use creosote oil. However, it is common to use a 180°–420° C. fraction obtained by the fractional distillation of the reaction product.

The hydrogenated heavy oil components to be used in the present invention, include a wide range of heavy oil components obtained by hydrogenation reactions. As a specific example, there may be mentioned a material mainly composed of heavy oil components separated from the second hydrogenation reaction product. Particularly preferred is such a material which also contains heavy oil components separated from the first hydrogenation reaction product. In the present invention, the heavy oil components are those components which have a boiling point of at least 420° C., and the oil fraction is a material which is light and middle oils which have at least 5 carbon atoms and which have a boiling point of not higher than 420° C. As the catalyst useful for the first hydrogenation reaction, iron type catalysts or molybdenum type catalyst may be used. The iron-type catalyst is particularly preferred. Suitable iron type catalysts include iron oxide, iron sulfide, converter dust, red mud and iron ore. Particularly preferred is a finely pulverized iron ore modified with sulfur. The catalyst is usually used in an amount of 0.5 to 20% by weight, preferably from 1 to 10% by weight as iron relative to the anhydrous ash-free coal.

As a molybdenum-type catalyst, there may be employed fine powder of molybdenum oxide or ammonium molybdate, or an organic or aqueous solution of ammonium molybdate. In general, the molybdenum catalyst is more expensive than the above-mentioned iron-type catalyst. However, it may be used in a smaller amount in a finely pulverized form.

The first hydrogenation reaction is usually conducted at a reaction temperature of from 350° to 500° C., preferably from 380° to 450° C. under a hydrogen partial pressure of from 50 to 500 kg/cm$^2$, preferably from 75 to 300 kg/cm$^2$ for a reaction time of from 5 to 120 minutes, preferably from 10 to 90 minutes.

After the completion of the first hydrogenation reaction, gaseous compounds are removed from the obtained reaction product, and then a light oil fraction and a solvent fraction are distilled. It is one of the features of the present invention that as compared with the conventional processes, the yield of the oil fraction in the first hydrogenation reaction is high in spite of the mild reaction conditions.

From the first hydrogenation reaction product, at least a part of the oil fraction is obtained as the desired product, and a fraction mainly composed of heavy oil components having higher boiling points than the desired oil fraction, is supplied to a deashing step. In the deashing process, solid components which include the ash content, the catalyst and unreacted coal, are removed. At the same time or in a separate operation, at least a part of the preasphaltene components is removed to obtin a deashed liquefied oil containing not greater than 20% by weight, preferably not greater than 15% by weight, of preasphaltene components. In the present invention, the preasphaltene components are substances which are soluble in pyridine, quinoline or tetrahydrofuran and insoluble in benzene or toluene, as described in a published literature ("Catalysts", Vol. 22 (1980) pages 60 and 71). As a method for separating the preasphaltene components, one such method is based on the differences in the solubility of the preasphaltene and the oil fractions to solvents. Another method of separation involves the use of liquid chromatography, which technique utilizes the differences in the chemical structural of materials to effect separation. However, a precipitation separation method such as a gravity precipitation or a centrifugal precipitation is advantageously used, both of which techniques utilize an aromatic solvent such as benzene or toluene, or naphtha obtained from the coal liquefaction step.

The removal of the preasphaltene components is intended to prevent the deterioration of the catalyst in the second hydrogenation step and coking of the catalyst, to improve the reaction yield of the deashed liquefied oil obtained from the second hydrogenation step and to moderate the reaction conditions of the second hydrogenation step. The greater the amount of the preasphaltene components removed, the wider becomes the range of freedom for the selection of the conditions of the second hydrogenation reaction including severe reaction conditions. On the other hand, the removal of preasphaltene involves a loss of effective components such as heavy oil components which are convertible to an oil fraction. There is no particular limitation to the lower limit of the content of the preasphaltene in the deashed liquefied oil, and the oil may contain as low as at least 5% by weight of the preasphaltene.

Namely, according to the present invention, it is one object to moderate the reaction conditions for the second hydrogenation reaction, and accordingly it is unnecessary to remove the preasphaltene components so strictly. The overall process can be smoothly operated even with relatively mild separation conditions such as a preasphaltene content of not greater than 20% by weight, preferably not greater than 15% by weight. This is another feature of the present invention, whereby the loss of effective components at the time of the separation of the preasphaltene components can be controlled to a minimal level.

Then, the deashed liquefied oil thus obtained is supplied for the second hydrogenation reaction. A solvent recovered from each hydrogenation reaction, for instance, a solvent having a boiling point of at least 180° C., may be supplied together with the deashed liquefied oil. Further, any other solvent which is commonly employed for the liquefaction of coals, such a coal-type or petroleum-type heavy oil fraction obtainable from other steps, may also be supplied with the deashed liquefied oil.

The catalyst to be used in the second hydrogenation reaction is preferably one prepared by having a metal of Group VI-B and a metal of Group VIII of the Periodic Table supported on a commercially available carrier such as alumina or silica-alumina, or on a solid acid such as an alumina prepared from boehmite. Specifically, cobalt nitrate or nickel nitrate and ammonium molybdate or ammonium tungstate are supported on such a carrier, followed by sintering, and the catalyst thereby obtained is sulfided with e.g. hydrogen sulfide or carbon disulfide prior to its use. It is also possible to use catalysts which are commonly employed for the desulfurization of the residual oils of petroleum.

The reaction system for the second hydrogenation step may vary as the case requires, and a fluidized bed system such as a boiling bed or moving bed system, may be employed. However, when conducted in a fixed bed system, the advantages of the present invention can be most effectively utilized. Particularly, it is significant that according to the present invention, the second hydrogenation reaction of a fixed bed type can be realized commercially and economically.

The second hydrogenation reaction is usually conducted at a reaction temperature of from 330° to 450° C. for a reaction time of from 0.1 to 5 hours under a hydrogen partial pressure of from 50 to 300 kg/cm$^2$. When the above-mentioned solvent is used, the weight ratio of the solvent to the solvent refined coal is preferably from 0.1 to 10. However, such reaction conditions may optionally be selected depending upon the nature of the desired product and the nature of the deashed liquefied oil as the feed material, and they are not particularly restricted.

According to the present invention, the reaction conditions of the hydrogenation step can be relatively moderated as mentioned above, and the reaction conditions may be selected within the above-mentioned respective ranges. It is desired, however, to select a combination of the conditions to provide mild conditions as a whole. The most influential temperature condition is preferably not higher than 430° C., more preferably not higher than 420° C.

After the completion of the second hydrogenation reaction, gaseous compounds are removed from the obtained reaction product, and then the heavy oil components and the desired oil fraction are separated.

The heavy oil components are recycled for the first hydrogenation reaction. The recycling amount is usually set to be at least 20% by weight, preferably at least 30% by weight, of the heavy oil components in the deashed liquefied oil, whereby the yield of the oil fraction in the first hydrogenation step can be remarkably improved and the reaction rate of the deashed liquefied oil in the second hydrogenation step, and consequently the reaction conditions for the second hydrogenation step can be moderated. If it is attempted to increase the reaction rate of the heavy oil components in the deashed liquefied oil, the reaction conditions in the second hydrogenation step would be severe, and the deterioration of the catalyst would accelerate, whereby it would be impossible to maintain a stabilized operation for a long period of time, and the amount of the heavy oil components to be recycled would be reduced and the advantageous effect of the heavy oil components to the first hydrogenation reaction would be reduced, and thus the yield of the oil fraction in the first hydrogenation step would not be improved.

From the foregoing, it should be apparent that the important features of the present invention, are the features in which the content of preasphaltene components is reduced to a level of not greater than 20% by weight, preferably not greater than 15% by weight, in the solvent deashing process and the feature in which heavy oil components in the second hydrogenation reaction products for recycling to the first hydrogenation reactor are controlled in amounts to a level of at least 20% by weight, preferably at least 30% by weight, of the heavy oil components in the deashed liquefied oil. These features improve the yield of the oil fraction in the first hydrogenation reaction step, improve the overall yield of the oil fraction during the overall reaction steps, moderate the reaction conditions for the second hydrogenation reaction step and realize an economically advantageous process for converting coal to an oil fraction. Thus, the industrial value of the present invention is extremely significant.

Now, the present invention will be described in detail with reference to the Examples. However, it should be understood that the present invention is by no means restricted to these specific Examples.

EXAMPLE 1

100 parts by weight (as anhydrous ash-free coal) of Morwell brown coal was pulverized to a particle size of at most 100 mesh, and mixed with 200 parts by weight of liquefied coal oil having a boiling point of from 180° to 420° C. and 50 parts by weight of recycled heavy oil components to obtain a slurry. An iron ore catalyst in an amount of 1.5% by weight as iron (relative to anhydrous ash-free coal) and sulfur in an amount of 1.2 molar times relative to the iron, were added. The mixture was supplied together with hydrogen to a continuous flow type three-tower series reactor, and reacted at 450° C. under a pressure of 150 kg/cm$^2$G for 1 hour. After the completion of the reaction, the reaction solution was separated by distillation to obtain 78 parts by weight of a heavy oil fraction (420° C.+ fraction) and 38 parts by weight of a oil fraction (420° C.− fraction). This heavy oil fraction was subjected to deashing and depreasphalting to obtain 65 parts by weight of a deashed liquefied oil containing 10% of preasphaltene components. The amount of the organic substances in the residue was 13 parts by weight.

The deashed liquefied oil was diluted with liquefied coal oil having a boiling point of from 180° to 420° C., and supplied to a Trickle bed type reactor packed with a Ni-Mo type catalyst (Ni content: 3.1% by weight, Mo content: 8.3% by weight), and the reaction was conducted at 380° C. under a hydrogen pressure of 200 kg/cm$^2$G at a liquid space velocity of 1 hr$^{-1}$. As the results, the conversion of the deashed liquefied oil to the oil fraction was 25%, and heavy oil components (420° C.+ fraction) corresponding to 75% relative to the heavy oil components in the deashed liquefied oil, were obtained. The yield of the oil fraction was 15 parts by weight, the yield of the heavy oil components was 50 parts by weight. All of the heavy oil components were recycled to the first hydrogenation step. The yield of the oil fraction (420° C.− fraction) throughout the entire process was 53 parts by weight.

EXAMPLE 2

The reaction was conducted in the same manner as in Example 1 except that the reaction conditions of the second hydrogenation step were changed to 400° C., a hydrogen pressure of 250 kg/cm$^2$. G and a liquid space velocity of 0.5 hr$^{-1}$. The conversion of the deashed liquefied oil to the oil fraction were 60%, and the heavy oil components corresponding to 40% relative to the heavy oil components in the deashed liquefied oil was obtained. No deterioration of the catalytic activity was observed over 1000 hours of the operation.

COMPARATIVE EXAMPLE 1

The reaction was conducted in the same manner as in Example 1 except that a deashed liquefied oil containing 40% of preasphaltene components, was used. At the initial stage of the reaction, the conversion of the deashed liquefied oil to the oil fraction was 20%, and heavy oil components corresponding to 80% relative to the heavy oil components in the deashed liquefied oil, were obtained. However, upon expiration of 500 hours, the catalytic activity decreased to a level of 60% of the initial activity.

COMPARATIVE EXAMPLE 2

The reaction was conducted in the same manner as in Comparative Example 1 except that the reaction conditions for the second hydrogenation step were changed to be severe at a temperature of 400° C. under a hydrogen pressure of 250 kg/cm$^2$.G and a liquid space velocity of 0.5 hr$^{-1}$. The conversion of the deashed liquefied oil to the oil fraction was 30%, and heavy oil components corresponding to 70% relative to the heavy oils components in the deashed liquefied oil, were obtained. However, upon expiration of 400 hours, the catalytic activity decreased to a level of 50% of the initial activity.

We claim:

1. A process for converting coal to an oil fraction, which comprises:
   (a) catalytically hydrogenating a mixture of coal, a solvent and a hydrogenated heavy oil having a boiling point of at least 420° C. in a first hydrogenation zone, said hydrogenated heavy oil comprising the heavy oil component present in and subsequently separated from the hydrogenation reaction product obtained from the first hydrogenation zone and the heavy oil component separated from the hydrogenated reaction product of the second hydrogenation zone below;
   (b) separating an oil fraction whose hydrocarbon molecules have a carbon atom content of at least five and which boils over a range up to a temperature not greater than 420° C. and a fraction mainly composed of heavy oil components which boil at a temperature of at least 420° C. from the reaction product of step (a);
   (c) deashing said fraction mainly composed of heavy oil components and simultaneously or independently removing preasphaltenes from said fraction;
   (d) separating at least a portion of the deashed oil fraction from the reaction product of step (c), said oil fraction containing from 5 to 20% by weight of preasphaltene components;
   (e) catalytically hydrogenating the portion of oil separated in step (d) in the presence of a nickel-molybdenum catalyst for from 0.1 to 5 hours in a second hydrogenation zone maintained at a temperature of from 330° to 450° C. under a hydrogen partial pressure of from 50 to 300 kg/cm$^2$;
   (f) separating an oil fraction having a boiling point not greater than 420° C. and a heavy oil component having a boiling point of at least 420° C. from the reaction product of step (e); and
   (g) recycling said separated heavy oil component to the first hydrogenation zone in an amount of at least 30% by weight relative to the heavy oil components in said deashed liquified oil of step (d).

2. The process according to claim 1, wherein the coal is brown coal or sub-bituminous coal.

3. The process according to claim 1, wherein the hydrogenation reaction in the first hydrogenation zone is conducted at a temperature of from 350° to 500° C. under a hydrogen partial pressure of from 50 to 500 kg/cm$^2$ for 5 to 120 minutes in the presence of an iron-type of molybdenum-type catalyst.

4. The process according to claim 1, wherein the deashed liquified oil supplied to the second hydrogenation zone contains not greater than 15% by weight of preasphaltene components.

5. The process according to claim 1, wherein the deashed liquified oil is supplied to the second hydrogenation zone together with a solvent having a boiling point of at least 180° C.

6. The process according to claim 1, wherein the second hydrogenation reaction is conducted in a fixed bed system.

7. A process for converting coal to an oil which comprises:
   (a) catalytically hydrogenating a mixture of coal, a solvent and a hydrogenated heavy oil having a boiling point of at least 420° C. in a first hydrogenation zone, said hydrogenated heavy oil comprising the heavy oil component present in and subsequently separated from the hydrogenation reaction product obtained from the first hydrogenation zone and the heavy oil component separated from the hydrogenated reaction product of the second hydrogenation zone below;
   (b) separating an oil fraction whose hydrocarbon molecules have a carbon atom content of at least five and which boils over a range up to a temperature not greater than 420° C. and a fraction mainly composed of heavy oil components which boil at a temperature of at least 420° C. from the reaction product of step (a);
   (c) deashing said fraction mainly composed of heavy oil components and simultaneously or independently removing preasphaltenes from said fraction;
   (d) separating at least a portion of the deashed oil fraction from the reaction product of step (c), said oil fraction containing from 5 to 20% by weight of preasphaltene components;
   (e) catalytically hydrogenating the portion of oil separated in step (d) in the presence of a catalyst for from 0.1 to 5 hours in a second hydrogenation zone maintained at a temperature of from 330° to 450° C. under a hydrogen partial pressure of from 50 to 300 kg/cm$^2$, said catalyst being prepared by supporting cobalt nitrate or nickel nitrate and ammonium molybdate or ammonium tungstate on a carrier, sintering and then sulfiding the resulting material;
   (f) separating an oil fraction having a boiling point not greater than 420° C. and a heavy oil component having a boiling point of at least 420° C. from the reaction product of step (e); and
   (g) recycling said separated heavy oil component to the first hydrogenation zone in an amount of at least 30% by weight relative to the heavy oil components in said deashed liquified oil of step (d).

8. The process according to claim 7, wherein the coal is brown coal or sub-bituminous coal.

9. The process according to claim 7, wherein the hydrogenation reaction in the first hydrogenation zone is conducted at a temperature of from 350° to 500° C. under a hydrogen partial pressure of from 50 to 500 $kg/cm^2$ for 5 to 120 minutes in the presence of an iron-type or molybdenum-type catalyst.

10. The process according to claim 7, wherein the deashed liquified oil supplied to the second hydrogenation zone contains not greater than 15% by weight of preasphaltene components.

11. The process according to claim 7, wherein the deashed liquified oil is supplied to the second hydrogenation zone together with a solvent having a boiling point of at least 180° C.

12. The process according to claim 7, wherein the second hydrogenation reaction is conducted in a fixed bed system.

* * * * *